US005481972A

United States Patent [19]

Schmid

[11] Patent Number: 5,481,972

[45] Date of Patent: Jan. 9, 1996

[54] DEVICE FOR REMOVING PRINTING-UNIT CYLINDERS FROM ROTARY PRINTING PRESSES

[75] Inventor: Gotthard Schmid, Malsch, Germany

[73] Assignee: Heidelberger Druckmaschinen AG, Heidelberg, Germany

[21] Appl. No.: 396,656

[22] Filed: Mar. 1, 1995

[30] Foreign Application Priority Data

Mar. 1, 1994 [DE] Germany ..... 44 06 573.6

[51] Int. Cl.[6] ..... B41F 5/00

[52] U.S. Cl. ..... 101/216; 101/479; 101/375

[58] Field of Search ..... 101/477, 479, 101/480, 216, 219, 152, 153, 141, 142, 180, 181, 218, 375

[56] References Cited

U.S. PATENT DOCUMENTS

| | | | |
|---|---|---|---|
| Re. 34,970 | 6/1995 | Tittgemeyer | 101/141 |
| 3,174,724 | 3/1965 | Verlik | 101/216 |
| 3,789,757 | 2/1974 | Motter et al. | 101/153 |
| 3,986,454 | 10/1976 | Granger | 101/216 |
| 4,807,527 | 2/1989 | Knauer | 101/216 |
| 4,823,693 | 4/1989 | Köbler | 101/218 |
| 5,142,979 | 9/1992 | Funada et al. | 101/183 |
| 5,237,920 | 8/1993 | Guaraldi | 101/216 |
| 5,241,905 | 9/1993 | Guaraldi et al. | 101/216 |
| 5,394,797 | 3/1995 | Döbler et al. | 101/216 |
| 5,398,604 | 3/1995 | Burke et al. | 101/479 |

FOREIGN PATENT DOCUMENTS

| | | |
|---|---|---|
| 683910 | 10/1930 | Germany . |
| 2058840 | 6/1972 | Germany . |

OTHER PUBLICATIONS

Polygraph–Verlag, 1952, pp. 93, 171 and 172 (Braun), "Der Tiefdruck, seine Verfahren und Maschinen".

*Primary Examiner*—Eugene H. Eickholt
*Attorney, Agent, or Firm*—Herbert L. Lerner; Laurence A. Greenberg

[57] ABSTRACT

Device for removing printing-unit cylinders from rotary printing presses having a transfer cylinder and a printing-unit cylinder, the rotary printing press including side walls formed with openings through which a bearing location of a printing-unit cylinder is accessible, includes surface portions defining one part of at least one opening of one of the side walls disposed concentrically to the axis of the transfer cylinder; the one opening including a removal region connected through the intermediary of a cutout to the bearing location of the printing-unit cylinder; the printing-unit cylinder, after removal of the transfer cylinder through the one opening which includes the removal region, being removable through the same one-opening removal region.

5 Claims, 4 Drawing Sheets

DEVICE FOR REMOVING PRINTING-UNIT CYLINDERS FROM ROTARY PRINTING PRESSES

BACKGROUND OF THE INVENTION

1. Field of the Invention

The invention relates to a device for removing printing-unit cylinders from rotary printing presses having side walls formed with openings through which a bearing location of a printing-unit cylinder is accessible.

Heretofore known from U.S. Pat. No. 5,142,979 is a device in which, on a rotary printing press operating in accordance with the so-called satellite principle, the inking units are accommodated in separately displaceable side walls. Two stock-conducting printing-unit cylinders and a plurality of cylinders, respectively, cooperating with the outer cylindrical surfaces of each of the printing-unit cylinders are supported fixed in position. Access to the cylinders is made possible by moving the side walls, which are supported on ball or roller bearings and which contain the inking units, away from the components which are held fixed in position, so that the pressman is able to enter into the free space which has thereby become available.

Once the space has been made accessible, a safety arrangement prevents any possible movement of the side walls accommodating the inking units, as long as operators are in the space.

In order to permit access to the cylinders, which are held fixed in position, for the performance of servicing operations or the like, it is necessary for large structural components to be moved out of precisely defined setting positions, such as, for example, relating to the positions of the inking rollers with respect to the ink-conducting printing-unit cylinders. After the performance of the servicing operations, the side walls with the inking units accommodated therein are returned to the original positions thereof. In all probability, there will then be a need for additional adjustment operations until the original state or conditions have been re-established.

In rotary printing presses which are equipped with a laser exposure or illuminating unit, exposure of the printing form is performed directly in the printing press, the laser exposure unit having been previously aligned very accurately in the rotary printing press. If it is intended that printing-unit cylinders are to be exchanged, assurance must be provided that the laser exposure unit be left in the position thereof in order to gain access to the components which are to be exchanged. Any readjustment of the laser exposure unit required after performance of servicing operations is not economically justifiable on account of excessively long downtime of the printing press, particularly not when it is frequently necessary to exchange complete printing-form cylinders.

SUMMARY OF THE INVENTION

Proceeding from the outlined prior art and the indicated problems in the case of rotary printing presses equipped with laser exposure units, it is an object of the invention to provide a device for removing printing-unit cylinders from rotary printing presses which affords a rapid and simple exchange of printing-unit cylinders for previously completely preassembled structural components.

With the foregoing and other objects in view, there is provided, in accordance with the invention, a device for removing printing-unit cylinders from a rotary printing press having a transfer cylinder and a printing-unit cylinder, the rotary printing press having side walls formed with openings through which a bearing location of a printing-unit cylinder is accessible, comprising means defining one part of at least one opening of one of the side walls disposed concentrically to the axis of the transfer cylinder; the one opening comprising a removal region connected through the intermediary of a cutout to the bearing location of the printing-unit cylinder; the printing-unit cylinder, after removal of the transfer cylinder through the one opening which comprises the removal region, being removable through the same one-opening removal region.

In accordance with another feature of the invention, the other of the side walls is located at a drive side of the rotary printing press, the other side wall being formed with openings from which bearing devices of the printing-unit cylinder are removable from outside the rotary printing press.

In accordance with a further feature of the invention, the printing-unit cylinder has cylinder journals of different lengths.

In accordance with an added feature of the invention, the other of the side walls is located at a drive side of the rotary printing press, and the cylinder journal of shorter length is accommodated in the side wall located at the drive side of the press.

In accordance with a concomitant feature of the invention, the openings formed in the other side wall located at the drive side of the press have an oblong extension.

Assurance is thereby provided in an advantageous manner that the exchange of printing-unit cylinders can be performed so as to combine minimum effort of removal with maximum retention of previously existing settings. Because the components which are to be exchanged, i.e., rubber-blanket and plate cylinders, are available in already completely preassembled form, the exchange of the printing-unit cylinders is possible within an extremely brief period of time through the dimensioning of the operating-side opening, without having to remove other assemblies inside the printing press and without having to change the settings thereof so that there would be a need for readjustment of such assemblies after the relevant components have been exchanged. Because the printing-unit cylinders can be removed from the respective side, relatively simple installation and removal can take place in an extremely confined space, without any need to readjust printing pressures or laser exposure or illumination units.

As noted hereinabove, in a further embodiment of the concept according to the invention, one side wall is formed with openings from which bearing devices of the printing-unit cylinder can be removed. Consequently, after the transfer cylinder has been removed from the side, it is possible to extend the swivelling range within the printing press of a further printing-unit cylinder which is to be removed subsequently. Furthermore, the further printing-unit cylinder has cylinder journals of different lengths. For the purpose of improved guidability during the swivelling movement of the further printing-unit cylinder to be exchanged, the operating-side cylinder journal is made longer. Conversely, the cylinder journal supported in the drive-side side wall is shorter, in order to move the swivelling location of the further printing-unit cylinder as close as possible to the drive-side side wall. Moreover, the bearing devices of the further printing-unit cylinder may be swivellable in the openings of the drive-side side wall. Because the openings in the drive-side side wall have an oblong extension, it is possible, after the transfer cylinder has been removed from the side, for the drive-side end of the further printing-unit cylinder to be moved away from laser exposure units until the drive-side cylinder journal is up against the end of the extension. Only then does the further printing-unit cylinder begin to be swivelled into the removal position thereof opposite the removal region of the operating-side opening. In an inclined position, the further printing-unit cylinder can be removed from the printing press, thereby reliably preventing any damage to the laser exposure units.

Other features which are considered as characteristic for the invention are set forth in the appended claims.

Although the invention is illustrated and described herein as embodied in a device for removing printing-unit cylinders from rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
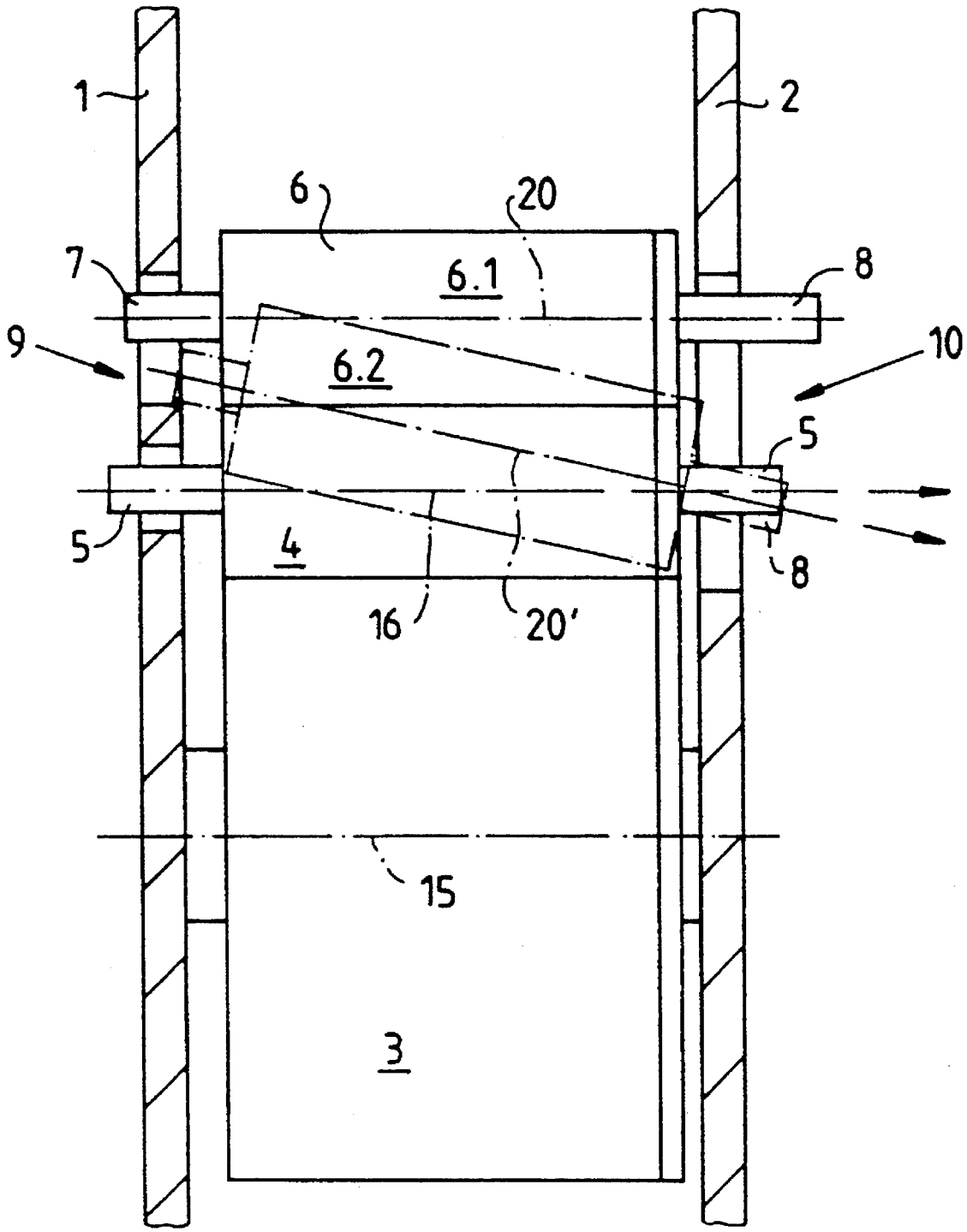
FIG. 1 is a fragmentary, diagrammatically represented cross-sectional view of a rotary printing press.

Referring now to the drawings and, first, particularly to FIG. 1 thereof, there is shown therein a diagrammatically represented cross-sectional view of a rotary printing press. A stock-conducting printing-unit cylinder 3 which, in the illustrated embodiment is a cylinder having a diameter with a length which is a multiple, i.e., double or treble, for example, the length of the conventional diameter of a plate, blanket or impression cylinder, is accommodated in side walls 1 and 2 on drive and operating sides, respectively, of the rotary printing press. A transfer cylinder 4 having cylinder journals 5 of like length on the drive and operating sides cooperates both with the outer cylindrical surface of the stock-conducting printing-unit cylinder 3 and also with a further printing-unit cylinder 6. The further printing-unit cylinder 6 has two cylinder journals 7 and 8, of which the drive-side cylinder journal 7 is shorter than the operating-side cylinder journal 8. The drive-side cylinder journals 5 and 7 of the transfer cylinder 4 as well as those of the further printing-unit cylinder 6 are accommodated in the side wall 1. Situated in a bearing opening 9 formed on the drive side is a bearing device for the further printing-unit cylinder 6, the bearing device, more particularly, being removable from outside. Formed in the side wall 2 on the operating side is an opening 10, through which the cylinder journals 5 and 8 of the transfer cylinder 4 and of the further printing-unit cylinder 6 extend.

The transfer cylinder 4 may be removed in a direction parallel to the rotational axis 16 thereof, i.e., in the direction of the horizontally disposed arrow. The transfer cylinder 4 may be removed in a completely assembled condition thereof from the rotary printing press, without having to disassemble specific assemblies, such as a rubber-blanket tensioning device or the like, within the printing press. After the transfer cylinder 4 has been removed, it is possible, after removing the removable bearing device for the cylinder journal 7 of the further printing-unit cylinder 6, for the further printing-unit cylinder 6 to be gripped by the longer cylinder journal 8 thereof and to be brought, in the printing press, into an inclined position thereof represented by the rotational axis 20' thereof. During this swiveling movement from the position 6.1 of the further printing-unit cylinder 6 shown in solid lines into position 6.2 thereof shown in phantom, the cylinder journal 7 is up against a limiting wall of the extension defining the opening 9 in the side wall 1. The removal of the further printing-unit cylinder 6 then takes place in the direction of the downward-inclined arrow, i.e., parallel to or in the same direction as that of the rotational axis 20' of the further printing-unit cylinder 6.

Figure 2:
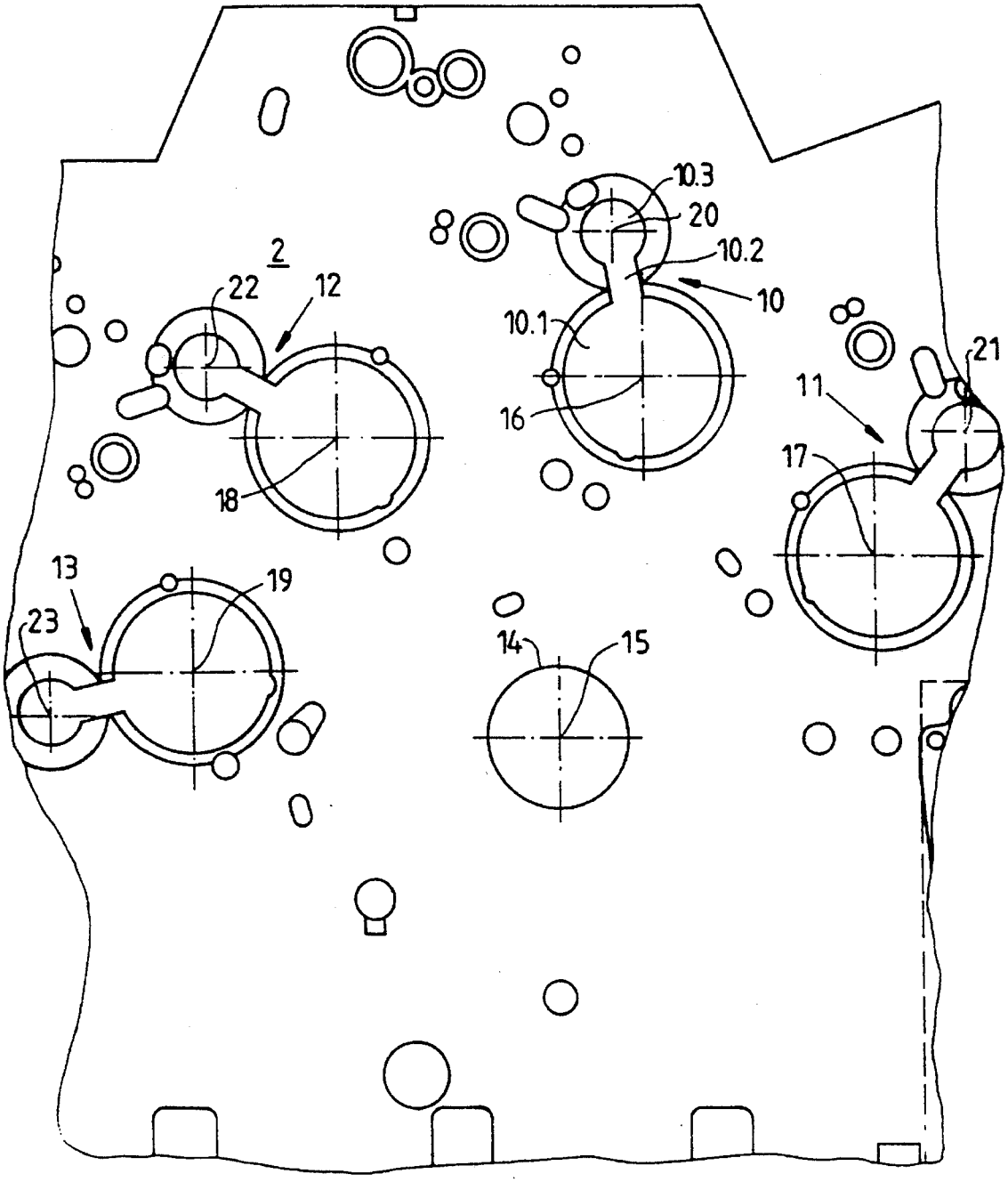
FIG. 2 is a side elevational view of FIG. 1 showing a side wall on the operating side of the rotary printing press.

As represented in FIG. 2, the side elevational view of the side wall 2 on the operating side of the rotary printing press shows the orientation of all openings 10, 11, 12 and 13 formed in the side wall 2. The configuration of the openings is described hereinafter in greater detail with reference to the opening 10, by way of example. The opening 10 includes a removal region 10.1, a cutout or recess 10.2 functioning as a connecting channel, and a bearing-bushing opening 10.3.

The removal region 10.1 has a center which coincides with the rotational axis 16 of a transfer cylinder. The removal region 10.1 is of such dimensions that a completely assembled printing-unit cylinder is able to pass through the removal region 10.1 without problem. Once the transfer cylinder 4 (see FIG. 1) has been removed, the cylinder journal 8 (see FIG. 1 also) of the further printing-unit cylinder 6 can be moved from the position thereof in which it is aligned with the horizontally disposed cylinder axis 20 into the position thereof in which it is aligned with the inclined cylinder axis 20'; that is, the further printing-unit cylinder 6 can be swivelled. This is possible due to the connecting channel 10.2, which lies on a non-illustrated imaginary connecting line between the rotational axis 20 of the further printing-unit cylinder 6 and the rotational axis 16 of the transfer cylinder 4. The further printing-unit cylinder 6, gripped at the longer cylinder journal 8 thereof, is removed from the printing press through the same removal region 10.1 through which the transfer cylinder 4 had been previously removed.

After one or more printing-unit cylinders have been exchanged, the procedure is completed, of course, in the reverse sequence. After the further printing-unit cylinder 6 has been introduced into the printing press, the longer cylinder journal 8 thereof is swiveled through the respective cutout 10.2, which functions as a connecting channel, into the bearing-bushing opening 10.3 on the operating side. Then, the bearing devices for the cylinder journal 7 are mounted in the opening 9. Thereafter, the cylinder journal 8 is fixed in position before the transfer cylinder 4 is placed between the stock-conducting printing-unit cylinder 3 and the assembled further printing-unit cylinder 6. Because the removal region 10.1 is adequately dimensioned, the printing-unit cylinders can be exchanged in completely preassembled condition, which renders superfluous any handling operations at locations within the printing press to which access is difficult.

In the side wall 2, a plurality of openings 10, 11, 12 and 13 are grouped around a bearing 14 of the printing-unit cylinder 3 in accordance with the satellite principle. Each of the openings 10, 11, 12 and 13 includes a removal region as well as a connecting channel and a bearing-bush opening, as explained hereinbefore with reference to the opening 10.

The centers of the individual removal regions of the openings 11, 12 and 13 are each coincident with the respective rotational axes 17, 18 and 19 of respective transfer cylinders, while respective rotational axes 21, 22 and 23 of further printing-unit cylinders each coincide with respective centers of bearing-bush openings corresponding to the position 10.3.

Figure 3:
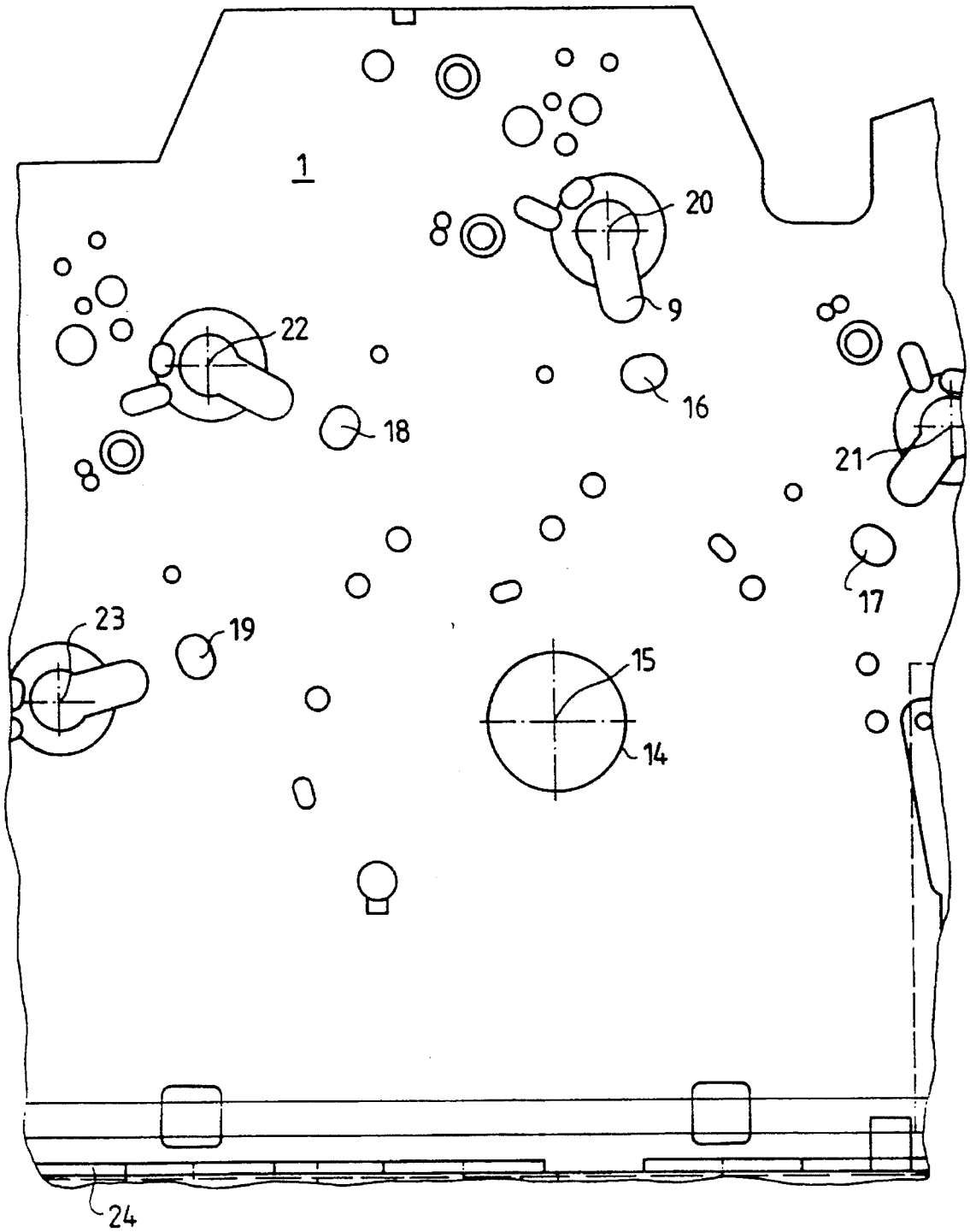
FIG. 3 is a side elevational view of FIG. 1 showing a side wall on the drive side of the rotary printing press.

FIG. 3 shows the side wall 1, wherein, in a manner similar to FIG. 2, the respective rotational axes 16, 17, 18 and 19 of the respective transfer cylinders are disposed, in accordance with the so-called satellite principle, around the bearing 14 of the printing-unit cylinder 3. The drive-side cylinder journals 7 of the further printing-unit cylinders 6 are mounted in the openings 9 formed in the side wall 1. The respective rotational axes of the further printing-unit cylinders are identified by respective reference characters 20, 21, 22 and 23. This representation clearly shows the orientation of the openings 9 in the side wall 1. The oblong region adjoining the circular part of the respective opening 9 is oriented in such a manner that the further printing-unit cylinders 6 can be swiveled in the printing press in a manner that the outer cylindrical surfaces thereof move away from the laser exposure or illumination units. There is consequently no possibility of any contact between the further printing-unit cylinders 6 and the exposure heads, as a result of which the adjusted positions thereof are not adversely affected. The configuration of the openings 9 permits swivelling of the further printing-unit cylinders supported on the drive side in the bearing bushings, after the respective bearing bushings have been removed.

Figure 4:
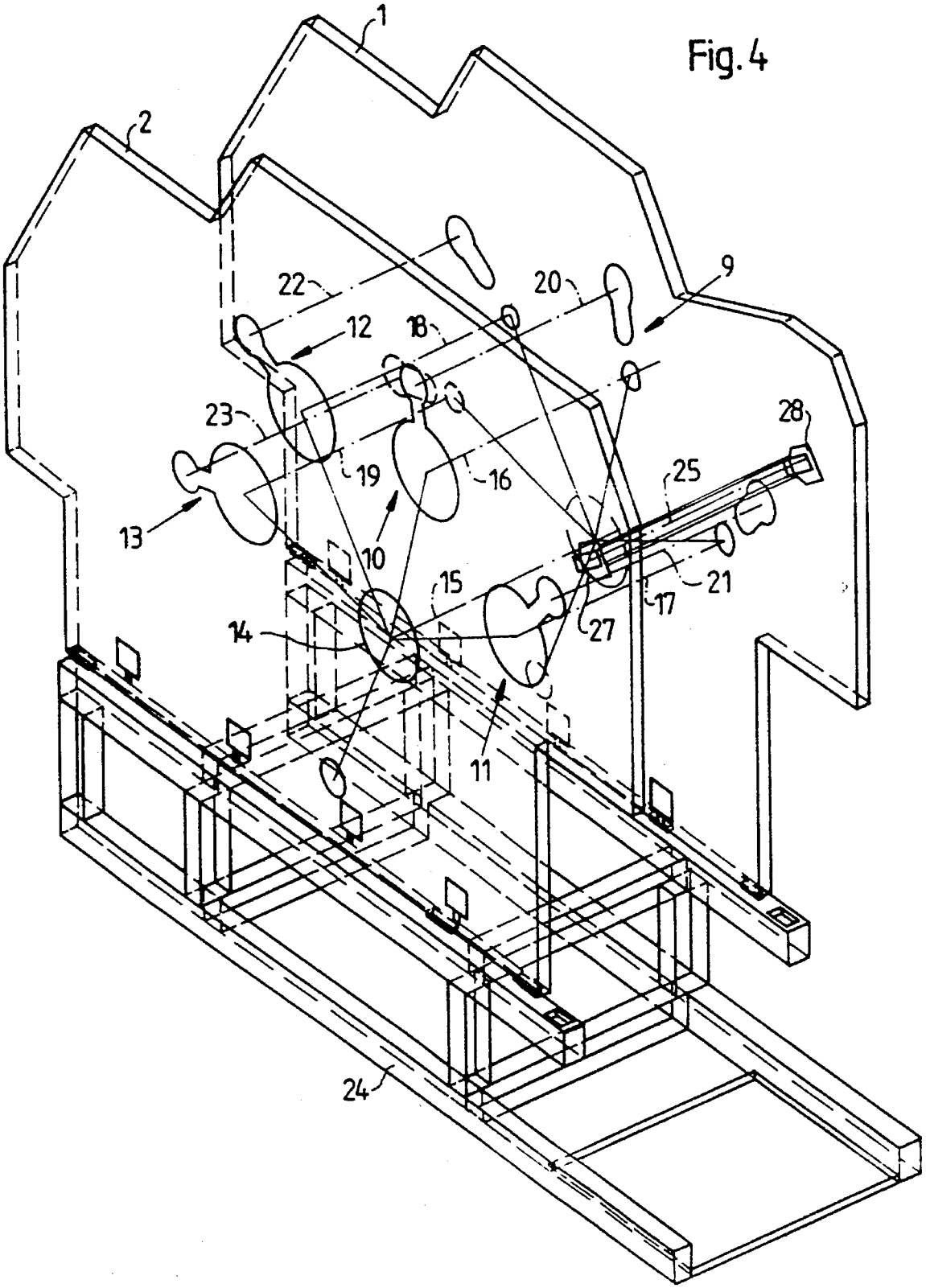
FIG. 4 is a fragmentary perspective view of the rotary printing press showing, disposed on a base frame, both the drive-side and operating-side side walls with bearing locations of the printing-unit cylinders.

FIG. 4 is a perspective view of the arrangement of the side walls 1 and 2 on a base frame 24. The side walls 1 and 2 mounted on the base frame 24 are connected by cross-members or traverses 25, of which, for reasons of clarity, only one is shown. The cross-members 25 are held on cross-member supports 27 and 28, respectively, provided in the side walls 1 and 2. It is believed to be readily apparent from the representation in FIG. 4 that the openings 10, 11, 12 and 13 formed in the side wall 2 are disposed around the rotational axis 15 of the stock-conducting printing-unit cylinder 3. The opening 11 in the side wall 2 serves to accommodate respective rotational axes 17 and 21 of the respective printing-unit cylinders supported therein. The opening 10, which has already been described in detail hereinbefore in conjunction with the description of FIG. 2, accommodates the operating-side cylinder journals of the respective printing-unit cylinders which are diagrammatically represented by the respective rotational axes 16 and 20. The respective rotational axes 18 and 22 of the respective printing-unit cylinders extend through the opening 12 on the operating side; the opening 13 accommodates the cylinder journals of the respective printing-unit cylinders which are represented by the respective rotational axes 19 and 23.

Four pairs of printing-unit cylinders arranged in accordance with the so-called satellite principle consequently cooperate with the outer cylindrical surface of the stock-conducting printing-unit cylinder 3.

I claim:

1. Device for removing printing-unit cylinders from a rotary printing press having a transfer cylinder and a printing-unit cylinder, the rotary printing press having side walls formed with openings through which a bearing location of a printing-unit cylinder is accessible, comprising means defining one part of at least one opening of one of the side walls disposed concentrically to the axis of the transfer cylinder; said one opening comprising a removal region connected through the intermediary of a cutout to the bearing location of the printing-unit cylinder; the printing-unit cylinder, after removal of the transfer cylinder through said one opening which comprises said removal region, being removable through the same one-opening removal region.

2. Device according to claim 1, wherein the other of the side walls is located at a drive side of the rotary printing press, the other side wall being formed with openings from which bearing devices of the printing-unit cylinder are removable from outside the rotary printing press..

3. Device according to claim 1, wherein the printing-unit cylinder has cylinder journals of different lengths.

4. Device according to claim 3, wherein the other of the side walls is located at a drive side of the rotary printing press, and the cylinder journal of shorter length is accommodated in the side wall located at the drive side of the press.

5. Device according to claim 2, wherein the openings formed in the other side wall located at the drive side of the press have an oblong extension.

* * * * *